US005534115A

United States Patent [19]

Hoyos et al.

[11] Patent Number: 5,534,115

[45] Date of Patent: Jul. 9, 1996

[54] PROCESS FOR PRESERVING THE MECHANICAL STRENGTH PROPERTIES OF CHEMICAL PAPER PULPS

[75] Inventors: Marc Hoyos, Cuesmes; Marcel Robberechts, Beersel; Paul Essemaeker, Brussels, all of Belgium

[73] Assignee: Interox International (Société anonyme), Brussels, Belgium

[21] Appl. No.: 39,146

[22] PCT Filed: Oct. 4, 1991

[86] PCT No.: PCT/EP91/01906

§ 371 Date: Apr. 15, 1993

§ 102(e) Date: Apr. 15, 1993

[87] PCT Pub. No.: WO92/07139

PCT Pub. Date: Apr. 30, 1992

[30] Foreign Application Priority Data

Oct. 17, 1990 [BE] Belgium ..... 09000985

[51] Int. Cl.[6] ..... D21C 9/147; D21C 9/16

[52] U.S. Cl. ..... 162/65; 162/76; 162/78; 162/80; 162/84

[58] Field of Search ..... 162/76, 78, 65, 162/80, 83, 84

[56] References Cited

U.S. PATENT DOCUMENTS 4,400,237 8/1983 Krüger et al. ..... 162/65

FOREIGN PATENT DOCUMENTS

0034219A1 8/1981 European Pat. Off. .
0187477A1 7/1986 European Pat. Off. .
0191756A1 8/1986 European Pat. Off. .
WO92/07139 4/1992 WIPO .

OTHER PUBLICATIONS

*Kirk–Othmer Encyclopedia of Chemical Technology, Second Edition,* vol. 16, pp. 724–727 (1968).

*Kirk–Othmer Encyclopedia of Chemical Technology, Fourth Edition,* vol. 4, pp. 301–311 (1992).

D. Lachenal et al, "Optimization Of Bleaching Sequences Using Peroxide As First Stage", *International Pulp Bleaching Conference,* 1982, pp. 145–151.

*Primary Examiner*—Steven Alvo

*Attorney, Agent, or Firm*—Spencer & Frank

[57] ABSTRACT

Process for preserving the mechanical strength properties of a chemical paper pulp, comprising two treatment stages by means of a peroxidic reagent, with the first stage in an acidic medium and the second stage in an alkaline medium, according to which a treatment by means of a reducing compound is interposed between the two stages.

10 Claims, No Drawings

PROCESS FOR PRESERVING THE MECHANICAL STRENGTH PROPERTIES OF CHEMICAL PAPER PULPS

FIELD OF THE INVENTION

The present invention relates to a process for preserving the mechanical strength properties of chemical paper pulps during treatments of these pulps for the purpose of delignifying or bleaching them. More particularly, it relates to a process where the delignification or bleaching treatment of these paper pulps comprises a sequence of two successive stages with a peroxidic reagent, the first stage being carried out in an acidic medium and the second stage in an alkaline medium.

TECHNOLOGY REVIEW

It is known to treat unbleached chemical paper pulps, obtained by digestion of lignocellulose materials, by means of a sequence of delignifying and/or bleaching treatment stages, involving the use of oxidising chemical products. Amongst these chemical products, chlorine and chlorine-containing oxidising agents such as chlorine dioxide and sodium hypochlorite have always been and still are most widely used because of their delignifying and bleaching properties with a view to the production of pulps of high whiteness and mechanical strength, which are intended for the manufacture of quality papers.

The researches carried out in recent years in the field of protecting the environment have demonstrated the polluting role of liquid wastes containing organochlorine residues, in particular those from bleaching plants in paper pulp factories. New legislation is appearing in a large number of countries, imposing a sometimes serious limitation on the quantity of organochlorine wastes in industrial effluents. This results in a research activity on the part of the paper industry for less polluting pulp-treatment sequences, leading to processes which have a reduced consumption of chlorine-containing reagents or even none at all.

Amongst the possible substitutes for chlorine and chlorine-containing reagents, peroxidic products are the materials of choice because of their harmlessness to the environment.

Delignification sequences for chemical pulps, which use two successive stages involving peroxidic reagents are known. The TAPPI document Proceedings of the 1982 International Pulp Bleaching Conference, pages 145 to 151, D. Lachenal, C. de Choudens, L. Soria and P. Monzie "Optimization of bleaching sequences using peroxide at first stage" discloses on page 146, table 3, a sequence which uses two stages which hydrogen peroxide, the first in an acidic medium and the second in an alkaline medium. In this process, only minor quantities of hydrogen peroxide (0.5% by weight relative to dry pulp) are used in each of the stages. When the quantities of hydrogen peroxide used are increased in order to obtain a more thorough delignification analogous to that achieved with the traditional bleaching/delignification sequences involving chlorine-containing reagents, a rapid decrease in the selectivity of the delignification is found, as shown by the decrease in viscosity of the pulp treated in this way.

SUMMARY OF THE INVENTION

The invention overcomes this drawback of the known processes by providing a novel delignification and/or bleaching process for chemical paper pulps, which allows high degrees of delignification to be achieved while preserving the intrinsic quality of the cellulose and the weight yield of pulp produced.

For this purpose, the invention relates to a process for preserving the mechanical strength properties of a chemical paper pulp during a two-stage delignification and/or bleaching treatment by means of a peroxidic reagent, the first stage being carried out in an acidic medium and the second stage in an alkaline medium, according to which a treatment with a reducing compound is interposed between the two stages.

DETAILED DESCRIPTION OF THE INVENTION

According to the invention, a chemical paper pulp is understood to mean pulps which have undergone a delignifying treatment in the presence of chemical reagents such as sodium sulphide in an alkaline medium (kraft digestion or sulphate digestion), sulphur dioxide or a metal salt of sulphurous acid in an acidic medium (sulphite digestion), a sulphurous acid salt in a neutral medium (neutral sulphite digestion, also called NSSC digestion).

The invention deals in particular with pulps which have undergone a kraft digestion and whose residual lignin content after digestion is in the range of kappa indices of between 15 and 35, according to the species of wood from which they come, and to the efficiency of the digestion process. All the wood types used for producing chemical pulps are suitable for the application of the process of the invention, and in particular those used for kraft pulps, namely the resinous woods such as, for example, the various species of pines and firs, and the hardwoods such as, for example, the beech, oak and hornbeam.

The peroxidic reagent is understood to mean any inorganic or organic reagent which contains in its molecule two oxygen atoms linked to one another by a covalent bond. The peroxidic compounds can be selected from the group comprising hydrogen peroxide, the metal peroxides and in particular the alkali metal peroxides or alkaline earth metal peroxides such as sodium peroxide, inorganic per-salts such as perborates, percarbonates and persulphates, inorganic peracids such as monoperoxysulphuric acid (Caro's acid) and diperoxysulphuric acid, organic peracids and in particular those containing 2 to 7 carbon atoms, such as peroxyacetic acid and peroxypropionic acid as well as salts thereof, and organic hydroperoxides and peroxides. Good results have been obtained with hydrogen peroxide, monoperoxysulphuric acid and the sodium salts thereof, peroxyacetic acid and sodium peroxyacetate. It is immaterial whether the peroxidic reagent is identical in the two process stages or is not the same in the acidic stage and in the alkaline stage. The best results were obtained with Caro's acid/alkaline hydrogen peroxide sequence (symbolised below by the initials $C_a$-P) and also with an acidic hydrogen peroxide/alkaline hydrogen peroxide sequence (symbolised below $P_a$-P).

The pH of the first stage with a peroxidic compound according to the invention is acidic and generally below 5. Preferably, this pH is between 0.5 and 3.5.

The pH of the second stage with a peroxidic compound must be alkaline and most frequently above 9. Preferably, the pH is between 10.5 and 13.5.

According to the invention, the reducing compound of the interposed stage can be any reducing product used in the paper pulp bleaching industry. Examples of such reducing products are formamidinesulphinic acid (FAS) and the ammonium, alkali metal or alkaline earth metal salts thereof, the borohydrides, hydrosulphites, sulphites or bisulphites of ammonium, an alkali metal or alkaline earth metal. FAS and sodium borohydride have given good results. FAS is preferred by reason of its greater efficiency.

The quantity of reducing agent used in the interposed stage is generally between 0.05 and 1.5% by weight relative to dry pulp. The preferred quantities are between 0.08 and 1.0%. A quantity of 0.1% already gives good results.

Between the first stage with the peroxidic compound and the interposed reducing stage, washing of the pulp with water can be carried out, followed by a reconcentration up to a dry matter content identical to that prevailing in the first stage. An advantageous variant of the process according to the invention is not to carry out any washing of the pulp between the first stage with the peroxidic compound and the interposed stage with the reducing compound. Equally, after the interposed reducing stage, there is the possibility of carrying out washing and reconcentration of the pulp before treating it with the alkaline peroxidic compound. Here again, an advantageous variant is not to carry out any washing between the interposed reducing stage and the stage with the alkaline peroxidic compound.

It is immaterial whether the pH of the interposed reducing stage is acidic or alkaline. Good results have been obtained with an alkaline pH between 10.5 and 13.5.

The duration, the temperature and the consistency of the interposed reducing stage are not critical. However, they must be selected carefully in each specific case as a function of various parameters such as the nature of the wood and of the reducing compound, the level of the kappa index, etc. The choice of these conditions will be determined by means of systematic exploratory laboratory tests within the range of any person skilled in the art who wants to optimise the parameters of the reaction. As a general rule the duration will be between 10 and 120 minutes, the temperature will be between 40° and 90° C. and the consistency will be between 5 and 30% by weight. Conditions of 20 minutes, 60° C. and 15% consistency have given good results in the case of a resinous pulp of kappa index 30 (untreated unbleached pulp from kraft digestion).

An advantageous variant of the process according to the invention consists in preceding the three treatment stages: acidic peroxidic compound—reducing compound—alkaline peroxidic compound by a predelignification stage. In this predelignification stage, any delignifying reagent such as chlorine, chlorine dioxide or the mixture of these two reagents, the caustic soda/anthraquinone composition, oxygen or a mixture of oxygen and hydrogen peroxide can be used indifferently. For ecological reasons, it is frequently desirable not to use any chlorine-containing reagent in this predelignification stage. This is why it is generally preferred to use oxygen or the oxygen/hydrogen peroxide combination as the delignifying reagent.

In another variant of the process according to the invention, if it is desired to obtain high degrees of whiteness, the second stage with an alkaline peroxidic compound can be followed by a sequence of traditional bleaching stages involving or not involving chlorine-containing reagents. The following are examples of such stages: chlorine dioxide, sodium hypochlorite, extractions with caustic soda in the presence or absence of hydrogen peroxide.

The process according to the invention is very suitable for producing half-bleached pulps free of any organochlorine residue. For this reason, it can be used for producing pulps involved in the manufacture of wrapping paper for use in the food industry.

The examples which follow are given in order to illustrate the invention, without limiting its scope in any way.

Example 1R (not according to the invention)

A sample of chemical pine pulp having undergone a kraft digestion (initial brightness 27.4° ISO measured according to the Standard ISO 2470, kappa index 29.3 measured according to the Standard SCAN C1:59) was mixed with 1% by weight of $H_2O_2$ and 1% by weight of $H_2SO_4$, relative to dry pulp. Deionised water was added in the quantity required to reach a 15% consistency and the sample containing the reagents was placed into a polyethylene bag which was immersed, after careful kneading, into a water bath thermostatically controlled at 60° C. After 2 hours of reaction, the pulp was washed in a volume of deionised water corresponding to 40 times its dry weight. After filtration over a Buechner filter, the pulp was transferred into another polyethylene bag and treated with 1% by weight of $H_2O_2$ and 2% by weight of NaOH, relative to dry pulp. Deionised water was then added to adjust the consistency to 12%, and the pulp was kneaded to homogenise the reagents, and was then allowed to react for 1 hour in a water bath thermostatically controlled at 60° C.

After the reaction, the pulp was washed in a volume of deionised water corresponding to 40 times its dry weight and filtered over a Buechner filter. This was followed by a determination of the viscosity of the treated pulp in accordance with the procedure described in the Standard TAPPI T 230.

The result of the viscosity measurement was 13.2 mPa.s.

Example 2 (according to the invention)

Example 1R was repeated, interposing, between the two $H_2O_2$ stages, a reducing treatment stage where 0.1% by weight of formamidinesulphinic acid and 1.5% of NaOH were used at 15% consistency for 20 minutes and at 60° C. After the interposed reducing stage, washing of the pulp under the same conditions as in Example 1R was carried out and the pulp was then treated with alkaline hydrogen peroxide. The quantity of NaOH in the alkaline hydrogen peroxide stage was, however, reduced to 0.5%, in order to employ the same total quantity of NaOH as in Example 1R.

The result of the viscosity measurement of the treated pulp was 15.1 mPa.s.

Examples 3R (not according to the invention) and 4 (according to the invention)

Examples 1R and 2R were repeated with another pine kraft pulp of kappa index 23. At the end of the treatment, the kappa indices (according to the Standard SCAN C1:59) and the tearing strength indices (according to the Standard TAPPI T 414) were measured.

The results obtained were as follows:

| Treatment sequence | Kappa index | Tearing index mN × m²/g |
|---|---|---|
| $P_a$-P | 16.4 | 4.5 |
| $P_a$-FAS-P | 16.5 | 5.9 |

Examples 5R (not according to the invention) and 6 (according to the invention)

Examples 1R and 2R were repeated with the same pine kraft pulp of kappa index 29.3, replacing the first stage with acidic hydrogen peroxide by a stage with Caro's acid in a quantity of 2% by weight of Caro's acid, relative to dry pulp.

The results of measuring the degree of polymerisation were:

| Treatment sequence | Viscosity of the pulp (mPa.s) |
|---|---|
| $C_a$-P | 18.4 |
| $C_a$-FAS-P | 20.6 |

Examples 7R (not according to the invention) 8 and 9 (according to the invention)

A pine kraft pulp of kappa index 23 was treated by means of delignification/low-chlorine bleaching sequences having the following characteristics:

| | Example 7R | Example 8 | Example 9 |
|---|---|---|---|
| 1st Stage (O/P): | | | |
| Reagents | $O_2$, 6 bar<br>$H_2O_2$, 1%<br>NaOH, 2.5%<br>$MgSO_4$, 0.1% | $O_2$, 6 bar<br>$H_2O_2$, 1%<br>NaOH, 2.5%<br>$MgSO_4$, 0.1% | $O_2$, 6 bar<br>$H_2O_2$, 1%<br>NaOH, 2.5%<br>$MgSO_4$, 0.1% |
| Temperature | 90° C. | 90° C. | 90° C. |
| Consistency | 12% | 12% | 12% |
| Duration | 60 min | 60 min | 60 min |
| 2nd Stage ($C_a$): | | | |
| Reagents | $H_2SO_5$, 2.0% | $H_2SO_5$, 2.0% | $H_2SO_5$, 2.0% |
| Temperature | 50° C. | 50° C. | 50° C. |
| Consistency | 15% | 15% | 15% |
| Duration | 60 min | 60 min | 60 min |
| 3rd Stage (R): | | | |
| Reagents | none | FAS, 0.1%<br>NaOH, 1.5% | $NaBH_4$, 0.1%<br>NaOH, 1.5% |
| Temperature | | 60° C. | 60° C. |
| Consistency | | 12% | 12% |
| Duration | | 30 min | 30 min |
| 4th Stage (P): | | | |
| Reagents | $H_2O_2$, 1.0%<br>NaOH, 2.0% | $H_2O_2$, 1.0%<br>NaOH, 0.5% | $H_2O_2$, 1.0%<br>NaOH, 0.5% |
| Temperature | 60° C. | 60° C. | 60° C. |
| Consistency | 12% | 12% | 12% |
| Duration | 60 min | 60 min | 60 min |
| 5th Stage ($D_1$): | | | |
| Reagents | $ClO_2$, 2.5% | $ClO_2$, 2.5% | $ClO_2$, 2.5% |
| Temperature | 70° C. | 70° C. | 70° C. |
| Consistency | 12% | 12% | 12% |
| Duration | 120 min | 120 min | 120 min |
| 6th Stage ($D_2$): | | | |
| Reagents | $ClO_2$, 0.5% | $ClO_2$, 0.5% | $ClO_2$, 0.5% |
| Temperature | 70° C. | 70° C. | 70° C. |
| Consistency | 12% | 12% | 12% |
| Duration | 120 min | 120 min | 120 min |

| | Example 7R | Example 8 | Example 9 |
|---|---|---|---|
| After the 1st stage O/P: | | | |
| Kappa index | 14.2 | 14.2 | 14.2 |
| Brightness, °ISO | 39.3 | 39.3 | 39.3 |

-continued

| | Example 7R | Example 8 | Example 9 |
|---|---|---|---|
| After the 2nd stage $C_a$: | | | |
| Kappa index | 11.7 | 12.1 | 12.1 |
| Brightness, °ISO | 41.5 | 41.4 | 41.4 |
| Viscosity, mPa.s | 11.8 | 11.8 | 11.8 |
| After the 4th stage P: | | | |
| Kappa index | 8.1 | 7.9 | 9.4 |
| Brightness, °ISO | 56.1 | 55.5 | 53.6 |
| After the 5th stage $D_1$: | | | |
| Kappa index | 2.6 | 3.4 | 2.6 |
| Brightness, °ISO | 69.3 | 63.4 | 70.0 |
| After the 6th stage $D_2$: | | | |
| Brightness, °ISO | 78.2 | 72.8 | 78.0 |
| Viscosity, mPa.s | 7.85 | 13.2 | 9.0 |

We claim:

1. A process for preserving the mechanical strength properties of a chemical kraft paper pulp during a delignification and bleaching treatment by means of a peroxidic reagent, comprising:

a first stage for delignifying and bleaching said chemical kraft paper pulp with a peroxidic reagent in an acidic medium, a second stage treating said delignified and bleached chemical kraft paper pulp with a reducing compound, and a third stage for further delignifying and bleaching said chemical kraft paper pulp with a peroxidic reagent in an alkaline medium.

2. The process according to claim 1, wherein the reducing compound is selected from the group consisting of formamidinesulphinic acid and the borohydrides, hydrosulphites, sulphites or bisulphites of ammonium, an alkali metal or an alkaline earth metal.

3. The process according to claim 1, wherein the reducing compound is formamidinesulphinic acid.

4. The process according to claim 3, wherein the reducing compound is applied in an alkaline medium.

5. The process according to claim 1, wherein the reducing compound is sodium borohydride.

6. The process according to claim 1, wherein in the first stage, the peroxidic compound is peroxymonosulphuric acid.

7. The process according to claim 1, wherein in the first stage, the peroxidic compound is hydrogen peroxide.

8. The process according to claim 1, wherein in the third stage, the peroxidic compound is hydrogen peroxide.

9. The process according to claim 1, wherein the three stages of treatment with an acidic peroxidic compound—reducing compound—alkaline peroxidic compound are preceded by a predelignification stage free of chlorine-containing reagent.

10. The process according to claim 9, wherein the predelignification stage is an oxygen stage or a stage combining oxygen and hydrogen peroxide.

* * * * *